United States Patent [19]

Robillard

[11] Patent Number: 5,053,320

[45] Date of Patent: Oct. 1, 1991

[54] DIRECT DRY NEGATIVE COLOR PRINTING PROCESS AND COMPOSITION

[75] Inventor: Jean J. A. Robillard, El Paso, Tex.

[73] Assignee: Richard L. Scully, Charlottesville, Va.

[21] Appl. No.: 509,193

[22] Filed: Apr. 16, 1990

[51] Int. Cl.[5] ..... G03C 7/28

[52] U.S. Cl. ..... 430/339; 430/167; 430/293; 430/333; 430/337; 430/156; 430/341; 430/345; 430/962

[58] Field of Search ..... 430/167, 333, 337, 156, 430/339, 345, 962, 341, 293

[56] References Cited

U.S. PATENT DOCUMENTS 4,010,033 3/1977 Metzger ..... 430/339

4,725,527 2/1988 Robillard ..... 430/339

*Primary Examiner*—Charles L. Bowers, Jr.
*Assistant Examiner*—Thorl Chea
*Attorney, Agent, or Firm*—Birch, Stewart, Kolasch & Birch

[57] ABSTRACT

The invention relates to a photosensitive composition for direct dry negative color printing composition. The photosensitive composition comprises a binder containing a plurality of grains of a semiconductor material, each grain having adsorbed on its surface one of three different complexes of spiropyran with a metal salt, each complex being sensitive to a different wavelength of light, a cross-linkable polymer and free radical initiator. The composition and process enables photofinishing or printing from a negative.

15 Claims, No Drawings

DIRECT DRY NEGATIVE COLOR PRINTING PROCESS AND COMPOSITION

This invention relates to photosensitive compositions for direct dry negative color printing.

In U.S. Pat. No. 4,725,527 to Robillard, there is disclosed photosensitive compositions for direct positive color photography. In the Specification, there is disclosed a process in which each color observed on the print corresponds with the color of the positive object image; e.g. transparency or slide. There is no disclosure in the said Specification for printing a negative. The process of Robillard relates to printing by transmission or reflection from a positive with general application for photocopier, printer etc. for paper, film or textiles. In addition, the process of Robillard only relates to printing from a positive such as a slide or a transparency.

In photofinishing color printing on paper generally uses negative films.

The colors on the negative film are complementary to the corresponding image color on the print viz.

| Negative | Print |
|---|---|
| Blue | Yellow |
| Green | Magenta |
| Red | Cyan |

In the production of color from a negative, the spectral distribution of the light source is important as undesirable color may be transmitted by the source to the printing emulsion. Ideally, a yellow image on the negative should be printed on the positive emulsion sensitive to blue using a blue light; a magenta image on the negative should be printed on the positive emulsion sensitive to green using a green light; and a cyan image on the negative should be printed on the positive emulsion sensitive to red using a red light.

An ordinary light bulb cannot be used for color printing unless the light is filtered by three monochromatic filters, red, blue and green. A separate exposure of the negative with each filter is necessary to obtain a true color rendition and the time of each exposure is adjusted to correspond to the sensitivity of the emulsion to the particular color. The three exposures can be reduced to one if the filtered lights of the three sources viz. red, blue and green are superimposed. In that case each source would be compensated to match the relative color sensitivity of each emulsion.

Another alternative is the use of a rotating disk with three color filters (red, blue and green) intercepting the light path to the negative to be printed.

Here again the density of color in the filters should be adjusted to the relative sensitivity of the printing emulsion for each color. The monochromaticity of the filters will determine the quality of color rendition: 450 nm for the blue, 555 nm for the green and 655 nm for the red.

Exposure without a filter can be made with a mercury-cadmium lamp with a very approximate matching of the spectral distribution required:

| Ideal (nm) | Hg—Cd (nm) |
|---|---|
| 450 | 468 |
| 555 | 508 |

-continued

| Ideal (nm) | Hg—Cd (nm) |
|---|---|
| 655 | 643 |

The principle of the process disclosed in Robillard is accelerated photobleaching. In the process, a dye of a given color is bleached by absorption of light corresponding to the same color and the bleaching process is accelerated (amplified) by electron exchange with an organic semiconductor. The positive emulsion contains three kinds of dye corresponding to red, blue and green. The dyes are distributed in three superposed layers or encapsulated and evenly distributed in a single layer. In the former case the layers are separated by a thin organic semiconductor layer. In the latter the semiconductor is placed between the substrate and the dye layer. In both cases the fixing of the image is obtained by thermal crosslinking of the binder containing the dyes.

It is an object of the present invention to provide photosensitive compositions for direct negative color printing.

The invention, therefore, provides a direct negative color photosensitive composition comprising a binder containing a plurality of grains of semiconductor each having absorbed on its surface one of three different photo-bleachable colored complexes of spiropyran with a metal salt, each complex being sensitive to a different wavelength of light of three colors viz. yellow, magenta and cyan, a crosslinkable polymer, and a free radical initiator.

To obtain a positive color picture from a negative original (Yellow, Magenta and Cyan) using the accelerated bleaching process disclosed in Robillard, the red, blue and green dyes (spiro complexes) should be replaced by equivalent cyan, yellow and magenta dyes (spiro complexes). The dye complexes would be sensitized in the same manner as disclosed in Robillard. However, complementary color dyes using spiropyran metal complexes are more difficult to prepare than the ones for the basic colors. The color selection (between Yellow, Magenta and Cyan) would be reached by changing the spiropyran structure rather than changing the complexing metal. For example:

1. Yellow (blue)

A. Spiro 2.3 diphenyl-7-methoxy-8'-nitro[4H,1-benzopyran-4-3' [3H] naphto [2-1-b pyran]

2. Magenta (green)

A. Spiro 3-ethyl-8-methoxy-3,-methyl, 6-nitro [2H-1 benzopyran-2.2, benzothiazoline]

3. Cyan (red)

A. Spiro 3,3'-dimethyl, 8-methoxy-6'-methylthio-6-nitro [2H-1-benzopyran-2,2'-benzothiazoline]

B. Spiro 8-methoxy-8'-nitro-3 phenyl bi-[2H naphto [2,3b] pyran]

The overall composition of the layers will be the same as for the positive process disclosed in Robillard.

The addition of the basic color dyes red, blue and green provide white when viewed with a white light (containing red, blue and green). If one of the three colors is missing (bleached) it is that same color which will be observed with white light. This appears contradictory but in fact, the white light used for viewing contains all three colors and if one of the three colors corresponding to the basic color is missing it will not absorb that color and only that color from the viewing light will be transmitted (or reflected); the other two colors will be absorbed by the dyes which have not been bleached. As a consequence, red and blue will be seen green, red and green will be seen blue, blue and green will be seen red when white light is used.

The addition of the complementary color dyes (Yellow, Magenta and Cyan), when viewed with a white light provide black. Because of the complementary nature of the colors, the associated spectral band is larger and the addition of two by two provides the basic color corresponding to the complementary color of the missing dye which has a narrower spectral band than the originals. For example:

*Cyan + Yellow = Green*

*Cyan + Magenta = Blue*

*Magenta + Yellow = Red*

The invention provides for a lower-cost, environmentally safe composition and process when compared with the prior art and currently used techniques of photofinishing. In particular the composition and process enables printing from a negative.

I claim:

1. A direct negative color photosensitive composition comprising a binder containing a plurality of grains of semiconductor each having absorbed on its surface one of three different photo-bleachable colored complexes of spiropyran with a metal salt, each complex being sensitive to a different wavelength of light of three colors viz. yellow, magenta and cyan, a crosslinkable polymer, and a free radical initiator.

2. The photosensitive composition of claim 1, wherein the binder is selected from the group consisting of polyvinyl alcohol, polyvinyl acetate, polyvinylpyrrolidone, carboxyethylcellulose, hydroxyethylcellulose and polyvinylchloride.

3. The photosensitive composition of claim 1, wherein the semiconductor grains are made of an inorganic semiconductor selected from the group consisting of zinc oxide, tin oxide, titanium dioxide, zirconium oxide, lead oxide, lanthanum oxide and cerium oxide.

4. The photosensitive composition of claim 1, wherein the semiconductor grains are made of an organic semiconductor of doped aromatic compounds selected from the group consisting of polyvinylcarbazole, polynaphthazarene, pyrazoline polymers, polyazines and polyphenylacetylene.

5. The photosensitive composition of claim 1, wherein the spiropyran complexes adsorbed on the semiconductor grains are made of spiropyran selected from the group consisting of spiro 2.3 diphenyl-7-methoxy-8'-nitro-[4H,1-benzopyran-4-3' [3H] naphto [2-1-b pyran], spiro 3-ethyl-8-methoxy-3'-methyl, 6-nitro [2H-1 benzopyran-2.2' benzothiazoline] spiro 3,3'-dimethyl, 8-methoxy-6'-methylthio-6-nitro [2H-1-benzopyran-2,2' benzothiazoline] and spiro 8-methoxy-8'-nitro-3 phenyl bi-[2H-naphto [2,3b] pyran].

6. The photosensitive composition of claim 1, wherein the semiconductor grains are made of an organic semiconductor of coordination metal complexes of polymers selected from the group consisting of Cu(I), Cu(II), Ni(II) and Pd(II) complexes of polyaminoquinone, polyvinyl alcohol, polydithioxamide, polythiocarbamic acid and polyquinoxalophenazine.

7. The photosensitive composition of claim 1, wherein the spiropyran complexes adsorbed on the semiconductor grains are complexed with metal salts selected from the group consisting of cuprous chloride, zinc chloride, cobaltous chloride, mercurous chloride, antimony chloride, bismuth chloride, barium naphthenate, lead napthenate and zinc naphthenate.

8. The photosensitive composition of claim 1, wherein the crosslinkable polymer is an unsaturated polyester dissolved in styrene.

9. The photosensitive composition of claim 1, wherein the free radical initiator is selected from the group consisting of peroxides, peresters, peracids, benzoin derivatives, azides and diazocompounds.

10. A photosensitive article comprising a substrate bearing a layer of a composition according to claim 1.

11. A photographic process, which comprises providing a layer of a composition according to claim 1 on a substrate, exposing the layer to a colored image, and heating the exposed layer to fix the image therein and to destroy the photosensitivity of the layer.

12. The photosensitive composition of claim 1, wherein a first complex of spiropyran with a metal salt is sensitive to yellow light, a second complex of spiropyran with a metal salt is sensitive to magenta light and a third complex of spiropyran with a metal salt is sensitive to cyan light.

13. The photosensitive composition of claim 6, wherein the polymers are granulated in powder form with grains smaller than 10 microns.

14. A direct negative color photosensitive article, which comprises:

a substrate, a first doped organic semiconductor, a bleachable blue spiropyran and metal salt complex dispersed or dissolved in a binder containing a crosslinkable polymer and additives to promote crosslinking;

a second doped organic semiconductor layer, a bleachable green spiropyran and metal salt complex dispersed or dissolved in a binder containing a crosslinkable polymer and additives to promote crosslinking, a third doped organic semiconductor layer, a bleachable red spiropyran and metal salt complex dispersed or dissolved in a binder containing a crosslinkable polymer and additives to promote crosslinking.

15. The photosensitive composition of claim 1, wherein the semiconductor is doped.

* * * * *